US009979125B2

(12) United States Patent
Hamada et al.

(10) Patent No.: US 9,979,125 B2
(45) Date of Patent: May 22, 2018

(54) FITTING STRUCTURE OF CONNECTOR

(71) Applicants: Yazaki Corporation, Tokyo (JP); HONDA MOTOR CO., LTD., Tokyo (JP)

(72) Inventors: Keiji Hamada, Utsunomiya (JP); Tomoyuki Miyakawa, Ustunomiya (JP); Kazuyuki Ochiai, Wako (JP)

(73) Assignees: Yazaki Corporation, Tokyo (JP); Honda Motor Co., Ltd., Tokyo (JP)

( * ) Notice: Subject to any disclaimer, the term of this patent is extended or adjusted under 35 U.S.C. 154(b) by 0 days. days.

(21) Appl. No.: 15/052,187

(22) Filed: Feb. 24, 2016

(65) Prior Publication Data

US 2016/0248193 A1 Aug. 25, 2016

(30) Foreign Application Priority Data

Feb. 25, 2015 (JP) ..... 2015-034864

(51) Int. Cl.
*H01R 13/629* (2006.01)
*H01R 13/52* (2006.01)
*H01R 13/627* (2006.01)

(52) U.S. Cl.
CPC ..... *H01R 13/629* (2013.01); *H01R 13/5221* (2013.01); *H01R 13/6272* (2013.01)

(58) Field of Classification Search
CPC ..... H01R 13/5202; H01R 13/5216; H01R 13/52; H01R 13/5208; H01R 4/023; H01R 11/11; H01R 9/0503
(Continued)

(56) References Cited

U.S. PATENT DOCUMENTS 4,405,192 A * 9/1983 Eaby ..... H01R 13/6273 439/358
5,145,356 A * 9/1992 Minnis ..... B60R 21/01 439/188
(Continued)

FOREIGN PATENT DOCUMENTS

CN 101141034 A 3/2008
CN 101425643 A 5/2009
(Continued)

OTHER PUBLICATIONS

Japanese Office Action for the related Japanese Patent Application No. 2015-034864 dated Jul. 4, 2017.
(Continued)

*Primary Examiner* — Harshad C Patel
(74) *Attorney, Agent, or Firm* — Kenealy Vaidya LLP

(57) ABSTRACT

A fitting structure of a connector which fits a pair of housings to each other, the fitting structure is provided with a first step portion and a second step portion on at least a part of an outer circumferential surface of one housing, and a third step portion and a fourth step portion on at least a part or an inner circumferential surface of the other housing. The first step portion extends in an axial direction. The second step portion protrudes more highly than the first step portion and is positioned on a rear side of the first step portion and extends in the axial direction. The third step portion is in contact with the first step portion and extends in the axial direction. The fourth step portion is in contact with the second step portion and extends in the axial direction.

12 Claims, 13 Drawing Sheets

(58) Field of Classification Search
USPC ..... 439/271, 272, 278, 283, 89, 732, 439/350–358
See application file for complete search history.

(56) References Cited

U.S. PATENT DOCUMENTS

| | | | | |
|---|---|---|---|---|
| 5,222,909 | A * | 6/1993 | Nomura | H01R 13/6593 439/271 |
| 5,605,471 | A * | 2/1997 | Plyler | H01R 13/641 439/352 |
| 5,975,929 | A * | 11/1999 | Matsuura | H01R 13/62972 439/157 |
| 6,206,716 | B1 * | 3/2001 | Saito | H01R 13/6272 439/352 |
| 6,213,793 | B1 * | 4/2001 | Norizuki | H01R 13/62933 439/157 |
| 6,332,799 | B1 * | 12/2001 | Torii | H01R 13/641 439/352 |
| 6,527,579 | B2 * | 3/2003 | Sato | H01R 13/4364 439/352 |
| 6,692,274 | B2 * | 2/2004 | Maegawa | H01R 13/62933 439/157 |
| 8,454,378 | B2 * | 6/2013 | Osterhart | H01R 13/4223 439/284 |
| 2002/0031944 | A1 * | 3/2002 | Endo | H01R 13/641 439/595 |
| 2003/0036302 | A1 | 2/2003 | Fukuda | |
| 2006/0003631 | A1 | 1/2006 | Fukatsu et al. | |
| 2008/0064250 | A1 | 3/2008 | Lee et al. | |
| 2009/0117770 | A1 | 5/2009 | Fukui et al. | |

FOREIGN PATENT DOCUMENTS

| | | | |
|---|---|---|---|
| CN | 102683973 | A | 9/2012 |
| JP | 11-067353 | A | 3/1999 |
| JP | 2006-19187 | A | 1/2006 |
| JP | 2008-166046 | A | 7/2008 |
| JP | 2011-82114 | A | 4/2011 |
| JP | 2013-239368 | A | 11/2013 |
| JP | 2013229168 | A | 11/2013 |
| WO | 2013161341 | A1 | 10/2013 |

OTHER PUBLICATIONS

Chinese Office Action for the related Chinese Patent Application No. 201610102253.9 dated Dec. 20, 2017.
Japanese Office Action for the related Japanese Patent Application No. 2015-034864 dated Mar. 6, 2018.

* cited by examiner

FITTING STRUCTURE OF CONNECTOR

CROSS REFERENCE TO RELATED APPLICATIONS

This application claims priority from Japanese Patent Application No. 2015-34864 filed on Feb. 25, 2015, the entire contents of which are incorporated herein by reference.

TECHNICAL FIELD

The present invention relates to a fitting structure of a connector.

BACKGROUND ART

In the related art, a waterproof connector that connects wires is mounted in an automobile or the like. For example, there has been known a connector that includes a female connector having a cylindrical inner housing in which a cavity that is able to accommodate a female terminal is formed and a cylindrical outer housing that surrounds the inner housing, and a male connector having a cylindrical male housing in which a cavity that is able to accommodate a male terminal is formed, the connector is formed by fitting both connectors together.

This type of connecter has an annular rubber packing mounted on an outer circumferential surface of the inner housing of the female connector. When both connectors are fitted to each other, the male housing is inserted into a gap between the inner housing and the outer housing of the female connector and packing come into close contact with the outer circumferential surface of the inner housing and the inner circumferential surface of the male housing, respectively. In this manner, water is prevented from infiltrating into the gap between cavities.

Incidentally, this type of connector includes locking mechanism for maintaining a fitting state of the male and female connectors. For example, an elastic member formed in the male housing is elastically inserted and locked into a locking hole formed in the outer housing of the female connector, and thereby both housings are locked to each other. However, when the male housing is inserted into the female housing in shaky fitting, there is a concern that the male housing will be locked in a state of shifting from a normal position, as a result, part of the packing will be intensely pressed and crushed, and then it is not possible to secure sealability.

In comparison, as a waterproof structure in which packing is not used, for example, there has been known a structure in which a resin sealing plate having elasticity is provided on a deep inside surface of the female housing, the cylindrical distal end of the male housing abuts against an annular sealing plate of the female housing over the entire circumference, and thereby infiltration of water is prevented when both connectors fit to each other (for example, refer to Patent Document 1).

RELATED ART DOCUMENT

Patent Document

[Patent Document 1] JP-A-2013-229168

SUMMARY OF THE INVENTION

Problem that the Invention is to Solve

However, since the sealing plate in Patent Document 1 is made of a resin, there is a concern that the sealing plate may be plastically deformed and the sealability will deteriorated when both housings fit to each other and the male housing abuts against the sealing plate in shaky fitting, in a state of being inclined.

In addition, when an electric wire (for example, a high-voltage cable) sticking out from the male housing is bent, the male housing receives a bending load and is inclined in some cases when the male housing is mounted in the shaky fitting. When the male housing is inclined in this manner, there is a concern that a gap will be formed between the male housing and the sealing plate, which will result in deterioration of the sealability. These problems can arise even in a case where rubber packing is used.

The present invention is presented in view of such problems and an object is that shaky fitting of a housing is suppressed such that deterioration of sealability of a connector is suppressed.

Means for Solving the Problem

In accordance with one or more embodiments, a fitting structure of a connector which fits a pair of housings to each other, the fitting structure of the connector is provided with a first step portion and a second step portion on at least a part of an outer circumferential surface of one housing, and a third step portion and a fourth step portion on at least a part of an inner circumferential surface of the other housing. The first step portion extends in an axial direction. The second step portion protrudes more highly than the first step portion and is positioned on a rear side of the first step portion and extends in the axial direction. The third step portion is in contact with the first step portion and extends in the axial direction. The fourth step portion is in contact with the second step portion and extends in the axial direction.

In the fitting structure of the connector, the one housing inserted into the other housing is supported by the other housing at positions which are separated from each other in the axial direction when the first step portion of the one housing comes into contact with the third step portion of the other housing and the second step portion of the one housing comes into contact with the fourth step portion of the other housing. In this manner, since a holding force for the one housing is increased and it is possible to suppress shaky fitting between the housings, it is possible to suppress deterioration of the sealability of the connector. In addition, when such fitting structures are formed at a plurality of positions (for example, at 90-degree interval) around the axis of both housings, respectively, it is possible to secure the same holding force with respect to an external force in another direction. Therefore, it is possible to further reliably suppress the deterioration of the sealability of the connector.

In accordance with one or more embodiments, the fitting structure of the connector is further provided with a rib protruding from the outer circumferential surface of the one housing and extending in the axial direction and a groove for guiding the rib in the inner circumferential surface of the other housing. The first step portion and second step portion are formed on rib and the third step portion and fourth step portion are formed on groove.

In the fitting structure of the connector, the ribs are guided through the grooves, and thereby it is possible to regulate movement of the pair of housings relatively in a rotation direction around the axis thereof. Accordingly, when an electric wire sticking out from the one housing is bent, the guide groove receives a bending load of the electric wire, which is applied to the one housing and it is possible to regulate rotation of the one housing. Therefore, it is possible to maintain the sealability of the connector.

In accordance with one or more embodiments, the pair of housings includes annular resin member on a peripheral edge of an opening end of a cavity in which a terminal is accommodated. The annular resin member of the one housing and the annular resin member of the other housing are fit to each other. Any one of the annular members is formed as a configuration that a distal end portion is pressed against an inner circumferential surface or an outer circumferential surface of the other of the annular members when the pair of housings fits to each other.

In the fitting structure of the connector, even in a sealing structure in which the annular resin members come into close contact with each other so as to achieve sealing, the shaky fitting between the housings is suppressed, and thereby it is possible to maintain an appropriate close contact state between the annular members. Therefore, it is possible to maintain the sealability of the connector. Further, according to the present invention, even in a sealing structure in which rubber packing is used, similarly, at is possible to maintain the sealability of the connector.

Advantage of the Invention

According to one or more embodiments, it is possible to suppress shaky fitting of a housing and to suppress deterioration of the sealability of the connector.

BRIEF DESCRIPTION OF THE DRAWINGS

FIG. 11A is a sectional view along arrows B-B in FIG. 2, and FIG. 11B is a partially enlarged view of the inside of a box in FIG. 11A.

FIG. 12A is a sectional view along arrows C-C in FIG. 2, and FIG. 12B is a partially enlarged view of the inside of a box in FIG. 12A.

BEST MODE FOR CARRYING OUT THE INVENTION

Hereinafter, one embodiment of a fitting structure of a connector, to which the present invention is applied, will be described with reference to FIG. 1 to FIG. 13. In the present embodiment, an example of a waterproof type of connector which is mounted in an automobile or the like is described; however, the connector of the present invention can be applied to a connector for another purpose.

Figure 1:
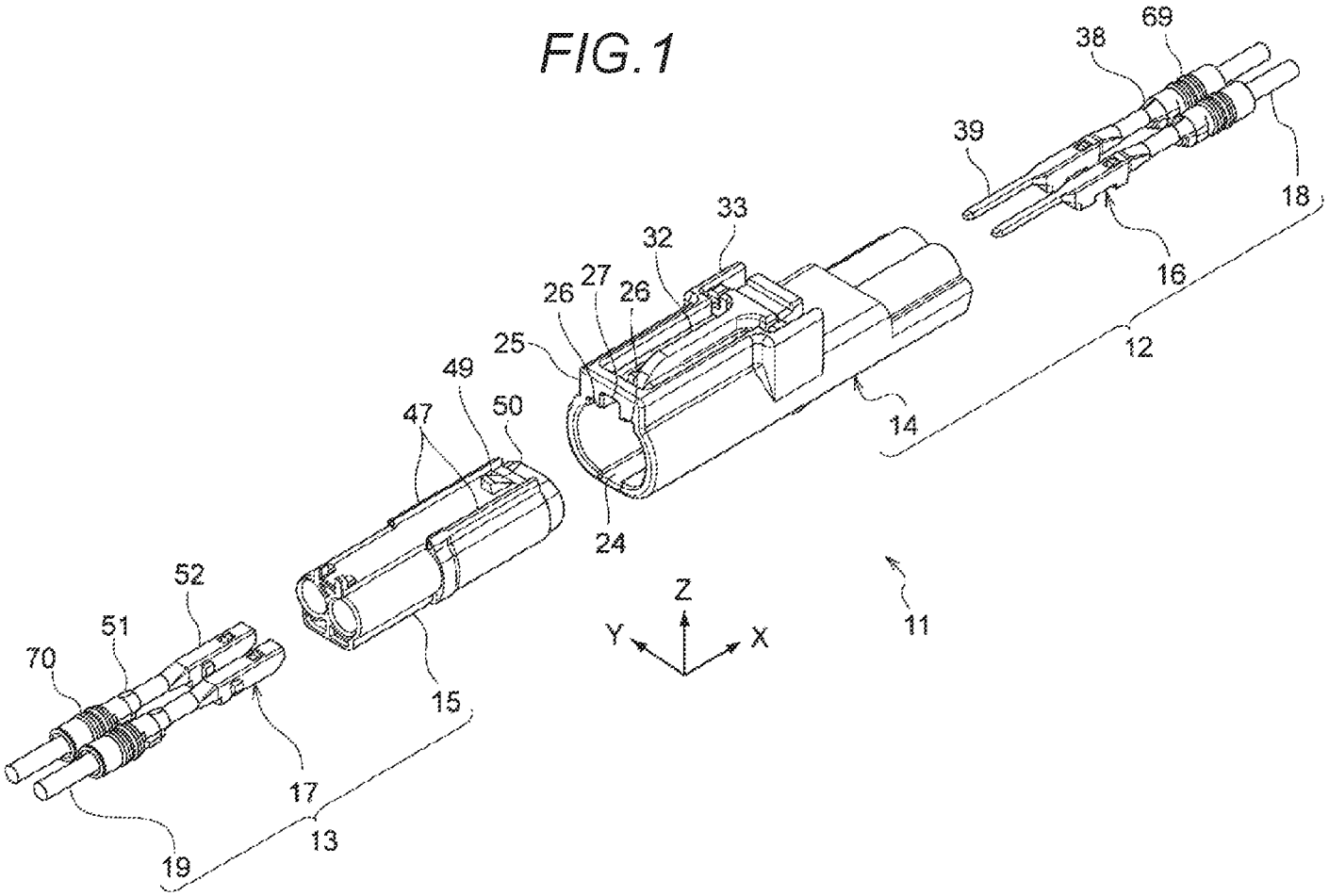
FIG. 1 is an exploded perspective view of a connector to which the present invention is applied.
Figure 2:
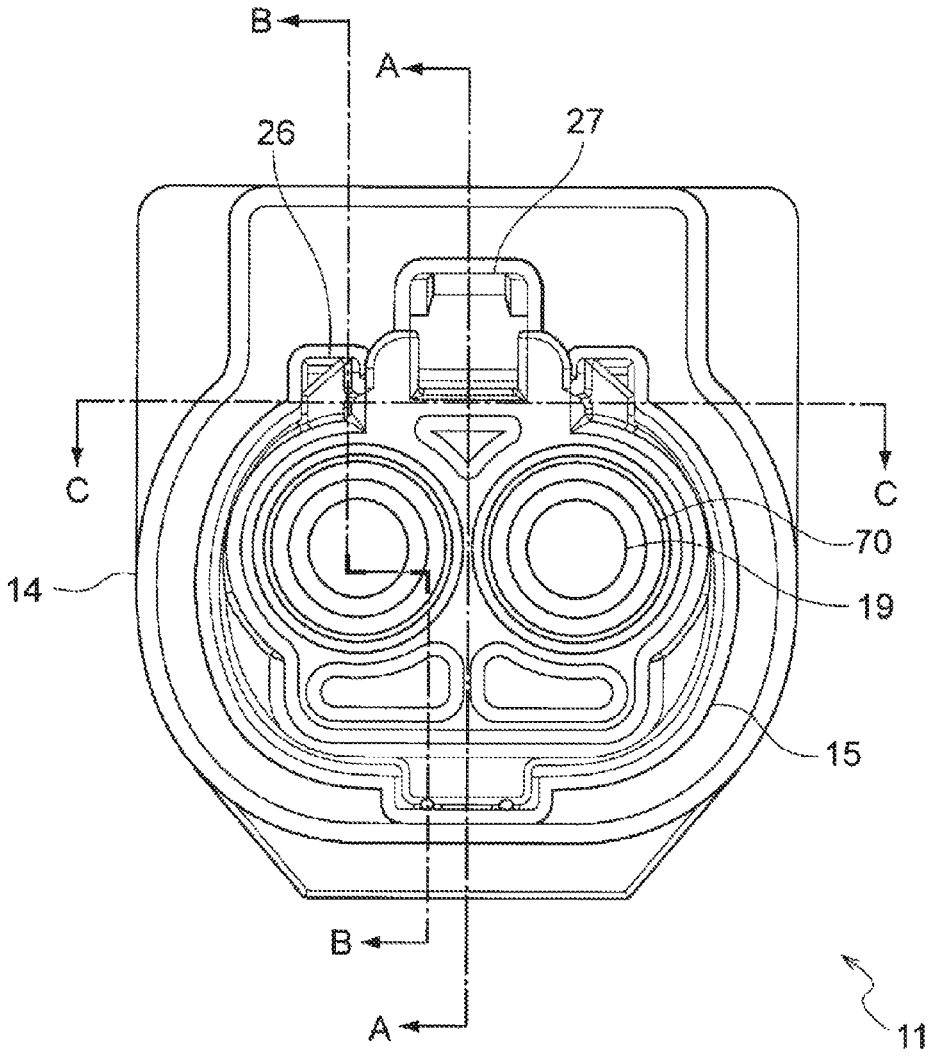
FIG. 2 is a view of the connector in FIG. 1 when viewed from behind the rear surface side of a female connector.

A connector 11 of the present embodiment is configured to include a male connector 12 and a female connector 13 as illustrated in FIG. 1 and FIG. 2, in which a male housing 14 of the male connector 12 and a female housing 15 of the female connector 13 fit to each other, and a male terminal 16 accommodated in the male housing 14 is electrically connected with a female terminal 17 accommodated in the female housing 15. An electric wire 18 is connected with the male terminal 16 and an electric wire 19 is connected with the female terminal 17. The female housing 15 fits and is locked into the inside of the male housing 14. In the present embodiment, an example in which two terminals are accommodated in each connector is described; however, the number of accommodated terminals is not limited to two. Further, in the following description, an X direction in FIG. 1 means a front-rear direction, a Y direction means a width direction, a Z direction means a height direction, fitting directions of both connectors are defined as the front sides, respectively, and the upper side in FIG. 1 is defined as upward.

Figure 3:
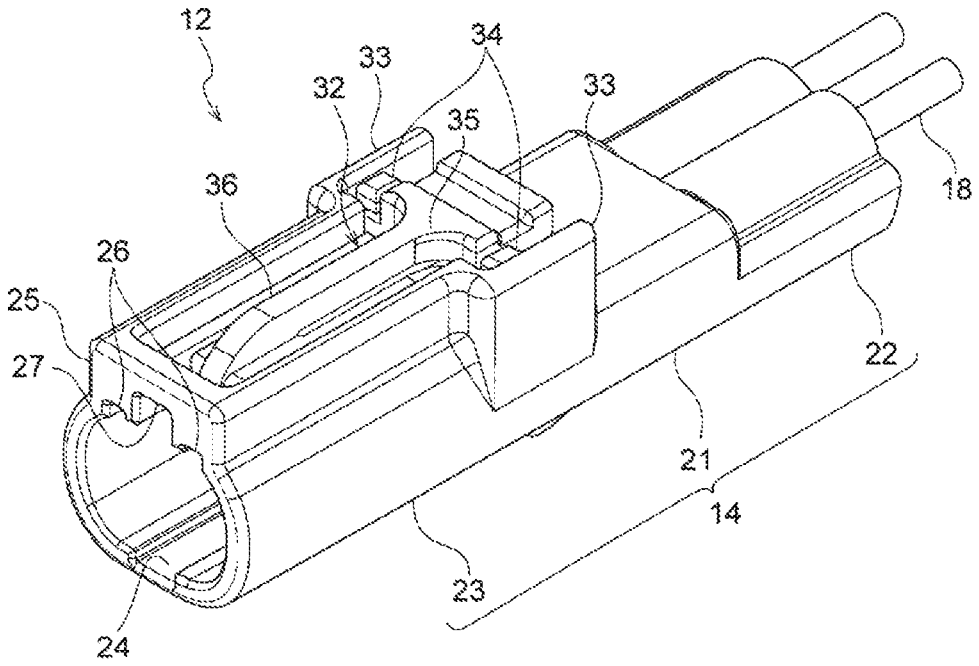
FIG. 3 is a perspective view of the external appearance of a male connector.
Figure 6:
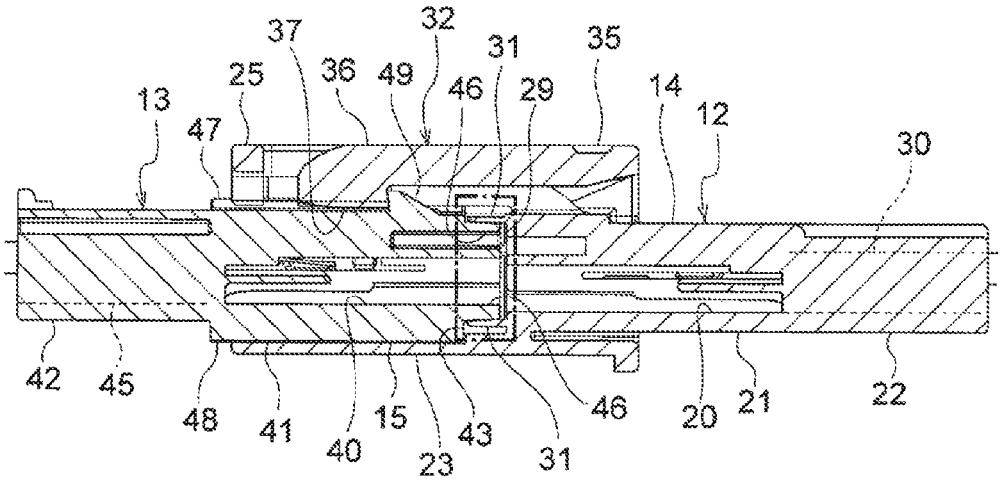
FIG. 6 is a sectional view along arrows A-A in FIG. 2.

As illustrated in FIG. 1 and FIG. 3, the male connector 12 has the male housing 14 formed of an insulating synthetic resin to have a cylindrical shape and the male terminal 16 which is accommodated in the male housing 14 from behind. As illustrated in FIG. 6, the male housing 14 is formed to include a cylindrical base section 21 in which a male terminal accommodating chamber (cavity) 20 that accommodates the male terminal 16 is formed, an electric wire holding section 22 protruding rearward from the base section 21, and a hood section 23 protruding to the front side from the base section 21, in an integral manner. The hood section 23 is formed to have a peripheral wall continuous to a peripheral wall of the base section 21 and has an elongated cylindrical shape in a sectional plane orthogonal to the axial direction.

As illustrated in FIG. 3, a guide groove 24 extending in the axial direction is formed in an inner wall of the hood section 23. In a plate-shaped upright wall section 25 flush with the front end surface of the hood section 23, a pair of groove openings 26 and a notched section 27 formed inside the pair of groove openings 26 are provided.

Figure 4:
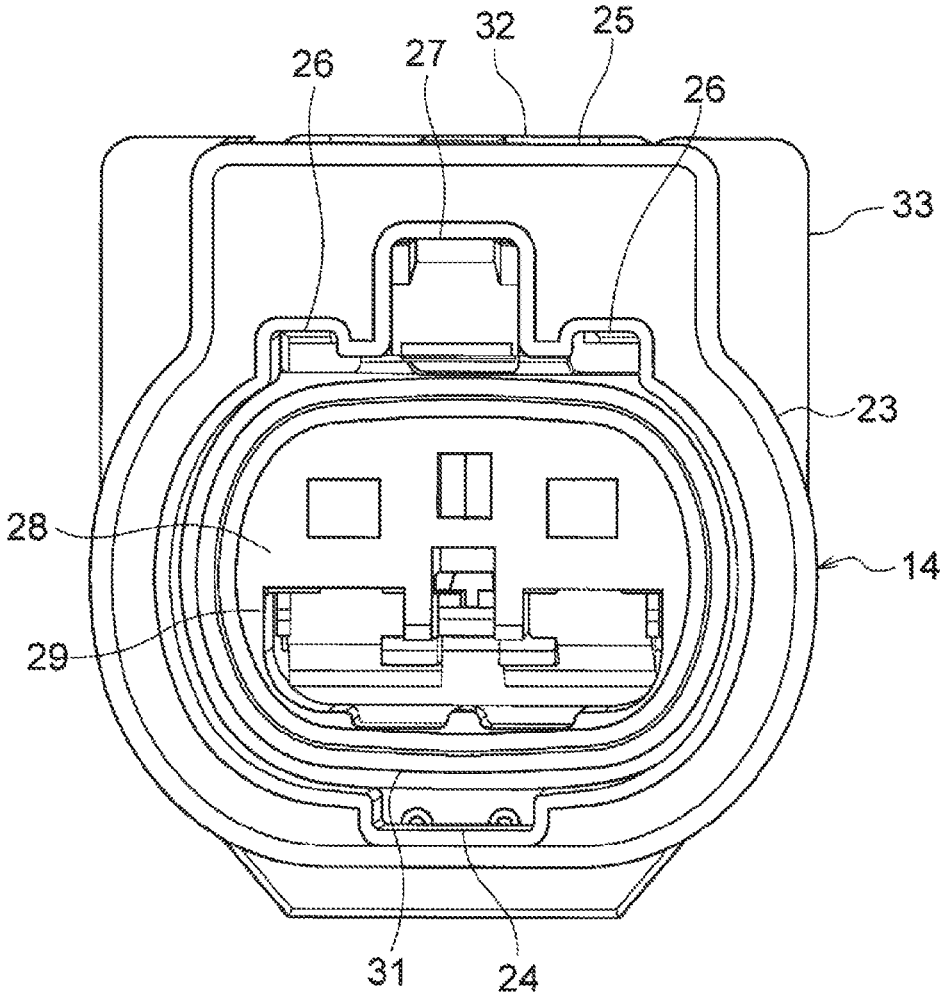
FIG. 4 is a front view of a male housing constituting the male connector.

The male terminal accommodating chamber 20 accommodates two male terminals 16 which are partitioned by a partition wall (not illustrated) and causes lances (not illustrated) extending in the inside of the male terminal accommodating chamber 20 to be joined to the male terminals 16 and to be held in a setting position. As illustrated in FIG. 4 and FIG. 6, the male terminal accommodating chamber 20 is formed with an opening end 29, which opens to a front end surface 28 of the base section 21 surrounded by the hood section 23, communicating with a through-hole 30, which penetrates though the electric wire holding section 22 in the axial direction. In the inside of the hood section 23, a cylindrical male-side annular member 31, which lengthens to the front side from a peripheral edge of the opening end 29 of the base section 21, is formed.

As illustrated in FIG. 3, the male housing 14 has a cantilever-like locking arm 32 lengthened to the front side in the axial direction along the outer surface. The locking arm 32 is formed to have two leg sections 34 supported by a pair of wall sections 33 which are upright from both side surface of the base section 21 in the width direction, respectively, a base end section 35 by which the leg sections 34 are lined up in the width direction, and an arm section 36 which lengthens to the front side from the base end section 35.

The front end portion of the arm section 36 of the locking arm 32 can be shifted upward from the horizontal direction with the base end section 35 as a support point. As illustrated in FIG. 6, a locking portion 37 protruding downward is provided under the front end of the arm section 36. As illustrated in FIG. 3, the wall sections 33 surround the locking arm 32 and are provided from the base section 21 of the male housing 14 to the wall section 25 of the hood section 23. An upper end surface of the locking arm 32 is provided to have the same height as the upper end surface of the wall sections 25 and 33 or to have a height lower than the wall sections.

As illustrated in FIG. 1, the male terminal 16 is formed of a conductive metal plate or the like and integrally includes an electric wire connecting portion 38, in which a crimp connection of the core wire of the electric wire 18 is performed, and a male tab 39 which is connected with the female terminal 17. The male tab 39 extends in the front-rear direction to have a rod shape, protrudes from the opening end 29, and is provided to further extend to the front side from the front end of the male-side annular member 31 in a state in which the male terminal 16 is held at a setting position of the male terminal accommodating chamber 20.

Figure 5:
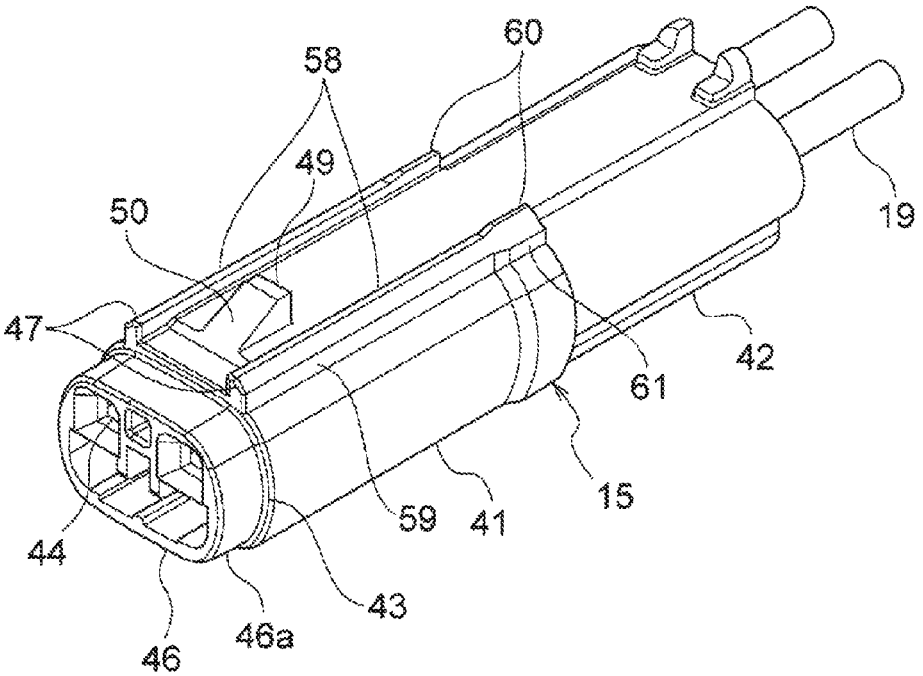
FIG. 5 is a perspective view of the external appearance of the female connector.

In comparison, as illustrated in FIG. 1, the female connector 13 has the female housing 15 formed of an insulating synthetic resin to have a cylindrical shape and the female terminal 17 which is accommodated in the female housing 15 from behind. As illustrated in FIG. 5 and FIG. 6, the female housing 15 is formed to integrally include a base section 41 which is formed to have substantially the same shape as the hood section 23 of the male housing 14 in a sectional plane orthogonal to the axial direction and in which two female terminal accommodating chamber (cavity) 40, into which the female terminal 17 is inserted, are formed, and an electric wire holding section 42 protruding rearward from the base section 41. The female terminal accommodating chamber 40 is formed to accommodate two female terminals 17 which are partitioned by a partition wall (not illustrated) from each other and causes lances (not illustrated) extending in the inside of the female terminal accommodating chamber 40 to engage with the female terminals 17 and to be held in a setting position.

As illustrated in FIG. 5 and FIG. 6, the female terminal accommodating chamber 40 is formed with an opening end 44, which opens to a front end surface 43 of the base section 41, communicating with a through-hole 45, which penetrates though the electric wire holding section in the axial direction. In the base section 41, cylindrical female-side annular member 46, which lengthens to the front side from a peripheral edge of the opening end 44, is formed. The female-side annular member 46 is formed to have a peripheral wall 46*a* formed with a peripheral wall of the base section 41 becoming smaller in a stepped shape.

As illustrated in FIG. 5, in the female housing 15, a pair of ribs 47, which protrude from the outer surface of the base section 41 on the upper side an extend in the axial direction, are provided. The pair of ribs 47 are provided to be separated in the width direction and each can come into contact with the inner circumferential surface of the male housing 14. On the base section 41 positioned in the inner side of the pair of ribs 47, a locking portion 49 which protrudes upward is provided. The locking portion 49 has an inclined surface 50 inclined downward toward the base section 41 on the front side and the locking arm 32 of the male housing 14 is pushed upward along the inclined surface 50 when both housings fit to each other.

Figure 8:
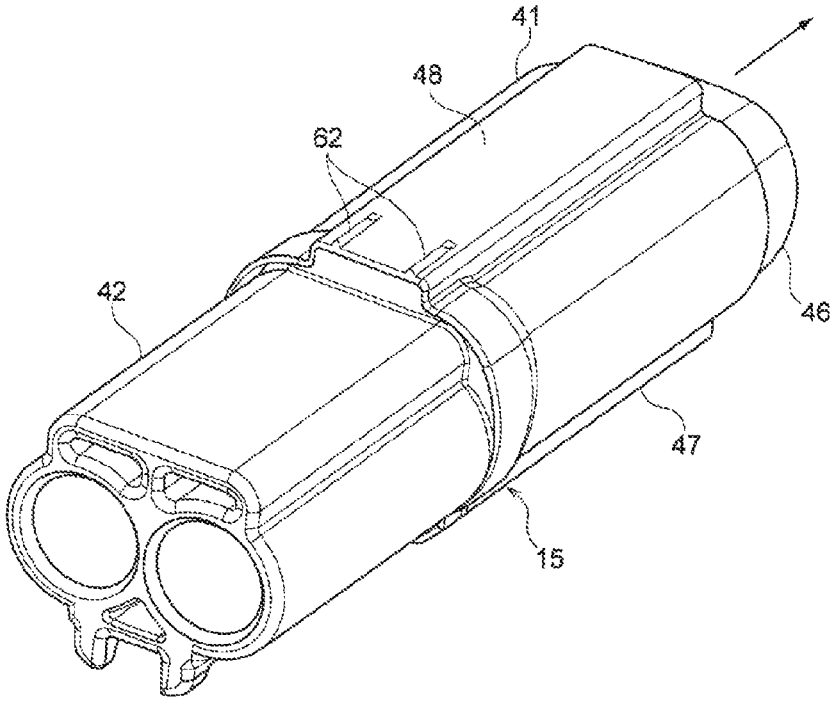
FIG. 8 is a perspective view of the external appearance of the female connector in FIG. 5 when viewed from below.

In addition, as illustrated in FIG. 6 and FIG. 8, in the female housing 15, a stepped portion 48, which protrudes from the outer surface of the base section 41 on the lower side and extends in the axial direction, is provided. The stepped portion 48 has substantially the same sectional shape as a groove sectional shape of the guide groove 24 so as to engage with the guide groove 24 of the male housing 14.

As illustrated in FIG. 1, the female terminal 17 is formed of a conductive metal plate or the like and integrally includes an electric wire connecting portion 51, in which a crimp connection of the core wire of the electric wire 19 is performed, and a rectangular tube-shaped electric contact section 52 to which the male tab 39 of the male terminal 16 is inserted and connected. In the electric contact section 52, a distal end portion is provided at a position at which the distal end portion is flush with the opening end 44 of the base section 41 or which is recessed from the opening end 44 by a setting distance in a state in which the female terminal 17 is held at a setting position of the female terminal accommodating chamber 40.

Figure 7:
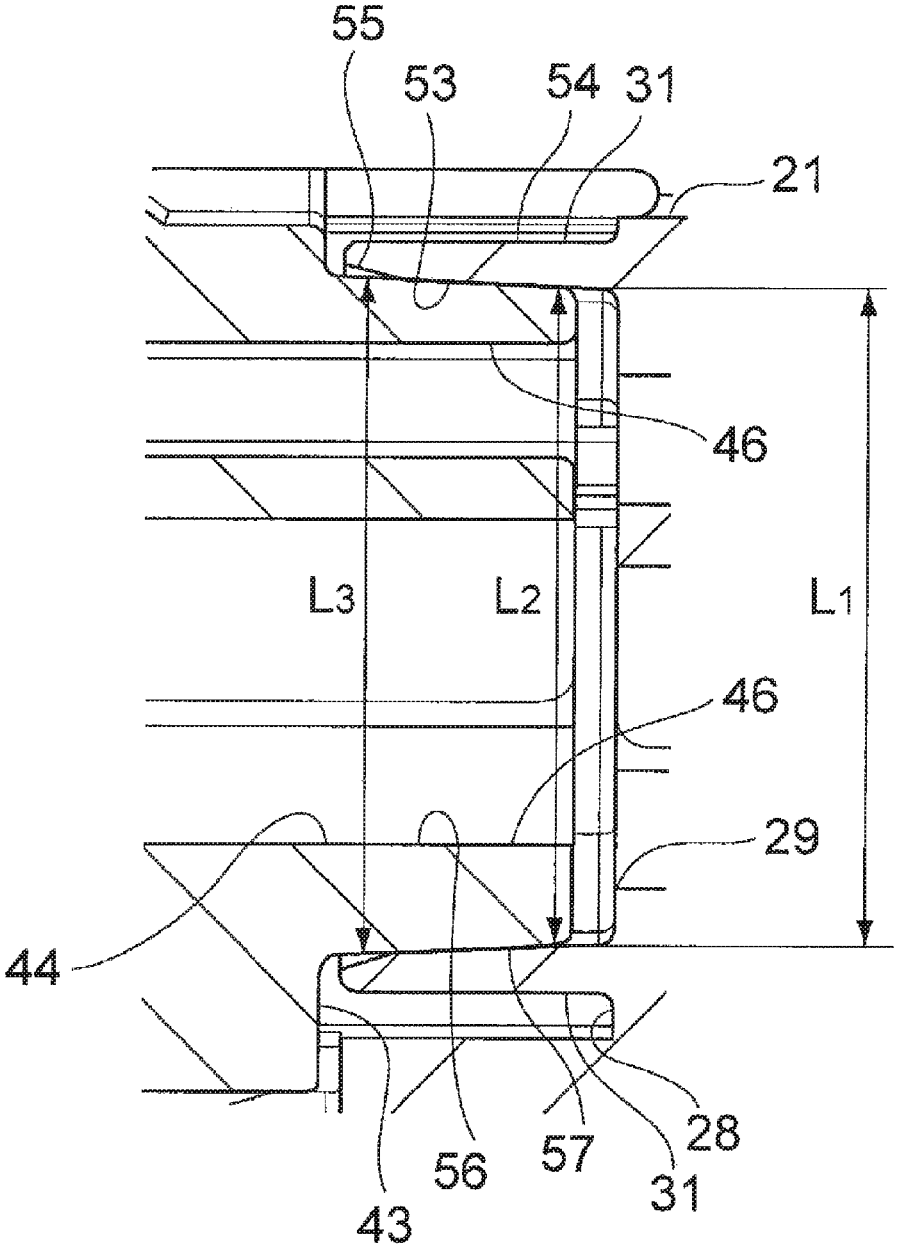
FIG. 7 is a partially enlarged view of the inside of a box in FIG. 6.

Next, a sealing structure of a gap between the opening end 29 of the male housing 14 and the opening end 44 of the female housing 15 will be described. In the present embodiment, when the male housing 14 and the female housing 15 fit to each other, the female-side annular member 46 fit into the inside of the male-side annular member 31. FIG. 7 is an enlarged view of the frame on FIG. 6. The male-side annular member 31 is a resin member lengthened from the peripheral edge of the opening end 29 of the base section 21 of the male housing 14 to have a cylindrical shape, has an inner circumferential surface 53 and an outer circumferential surface 54 which extend in parallel with the axis of the male housing 14, and is set to have a constant thickness in the axial direction. Further, in the present embodiment, a chamfering portion 55 is widened toward the front on a distal end of the inner circumferential surface of the male-side annular member 31. The female-side annular member 46 is guided to the male-side annular member 31 along the chamfering portion 55.

In comparison, the female-side annular member 46 is a resin member lengthened from the peripheral edge of the opening end 44 of the base section 41 of the female housing 15, an inner circumferential surface 56 in parallel with the axis of the female housing 15, and an outer circumferential surface 57 that is widened and inclined rearward (depth) in the axial direction. That is, the female-side annular member 46 is formed to have diameter which is gradually increased as close to the rear side from the front end. In addition, in the present embodiment, an amount of protrusion of the female-side annular member 46 from the front end surface 43 is set to be less than an amount of protrusion of the male-side annular member 31 from the front end surface 28.

In the present embodiment, when inner dimension between the inner circumferential surfaces 53 of the male-side annular member 31, which face each other in a height direction is represented by L1 and outer dimension of the front end portions and the rear end portions between the outer circumferential surfaces 57 of the female-side annular member 46, which face each other in a height direction is represented by L2 and L3, a dimension relationship of L2<L1<L3 is satisfied. The dimension relationship is set over the entire periphery of the male-side annular member 31 and the female-side annular member 46. Therefore, the inner circumferential surface 53 of the front end portion of the male-side annular member 31 is pressed against the outer circumferential surface 57 of the female-side annular member 46, according to the insertion of the female-side annular member 46. In this manner, the annular members 31 and 46 are brought into close contact to each other, and thereby it is possible to obtain sealability and vibration absorbing effect.

Next, a fitting structure of the male housing 14 and the female housing 15 which is a feature of the present embodiment will be described. First, as illustrated in FIG. 5, the female housing 15 has a pair of ribs 47, which protrude from the outer circumferential surface of the base section 41 and extend in the axial direction, formed with vertical symmetry and each of the ribs 47 has a top-surface portion 58 extending in the axial direction and a side-surface portion 59 extending in the axial direction along the top-surface portion 58. The top-surface portion 58 is formed to have a horizontal surface and the side-surface portion is formed to have a flat surface perpendicular to the top surface section. A rear top-surface portion 60 which protrudes as one step high as the top-surface portion 58 and extends in the axial direction is provided on the rear side of the top-surface portion 58 and the rear top-surface portion 60 is continuous to the rest of the top-surface portion 58 and the inclined surface. The rear side-surface portion 61, which protrude as one step high as the side-surface portion 59 in the width direction and extends in the axial direction, is provided on the rear side of the side-surface portion 59 and rear side-surface portion 61 is continuous to the rest of the side-surface portion 59 and the inclined surface. In this manner, a surface, which extends in the axial direction to have a stepped shape, is formed on each of the top-surface portion 58 and the side-surface portion 59.

In addition, as illustrated in FIG. 8, on the outer circumferential surface of the female housing 15, a pair of protrusions 62 are formed on the rear side (front side in FIG. 8) of the stepped portion 48. The pair of protrusions 62 are disposed substantially in parallel to be separated from each other in the width direction, and are formed to have a semicircular shape in the sectional plane and to extend in the axial direction. The protrusions 62 are continuous to the stepped portion 48 on the front side and to the inclined surface. In this manner, the stepped portion 48 has a surface formed to extend in the axial direction and to have a stepped shape. Further, the stepped portion 48 can be formed as a flat stepped surface having a different height, instead of the pair of protrusions 62.

Figure 9:
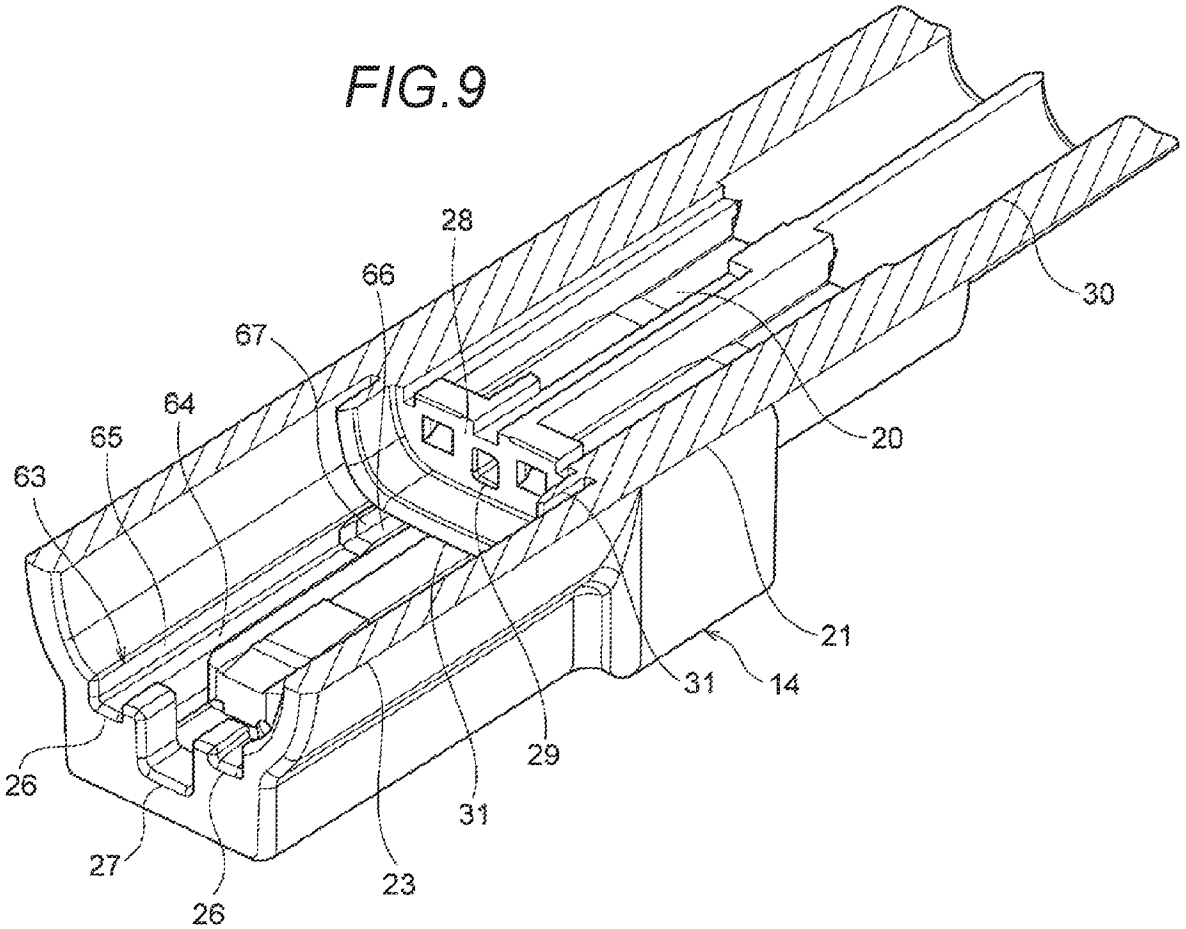
FIG. 9 is a perspective sectional view of the upper half of the male connector in FIG. 3 when viewed from the inside.

In comparison, as illustrated in FIG. 9, on the inner circumferential surface of the male housing 14, a pair of grooves 63, which are continuous to each of groove openings 26 and extend in the axial direction, are formed. The pair of grooves 63 are rail-like grooves which have a under-surface portion 64 corresponding to the top-surface portion 58 of the rib 47 of the male housing 14 and a side-surface portion 65 corresponding to the side-surface portion 59 of the rib 47 and have an L shape in the sectional plane. A rear under-surface portion 66 rising to the inner side is formed to extend in the axial direction, on the rear side of the under-surface portion 64 of each of the grooves 63 and a rear side-surface portion 67 rising to the inner side is formed to extend in the axial direction, on the rear side of the side-surface portion 65 of each of the grooves 63. The rear under-surface portion 66 and the rear side-surface portion 67 are continuous to the inclined surfaces of the rest of the under-surface portion 64 and the side-surface portion 65, respectively. In this manner, the under-surface portion. 64 and the side-surface portion 65 of the grooves 63 have surfaces formed to extend in the axial direction and to have a stepped shape, respectively.

Figure 10:
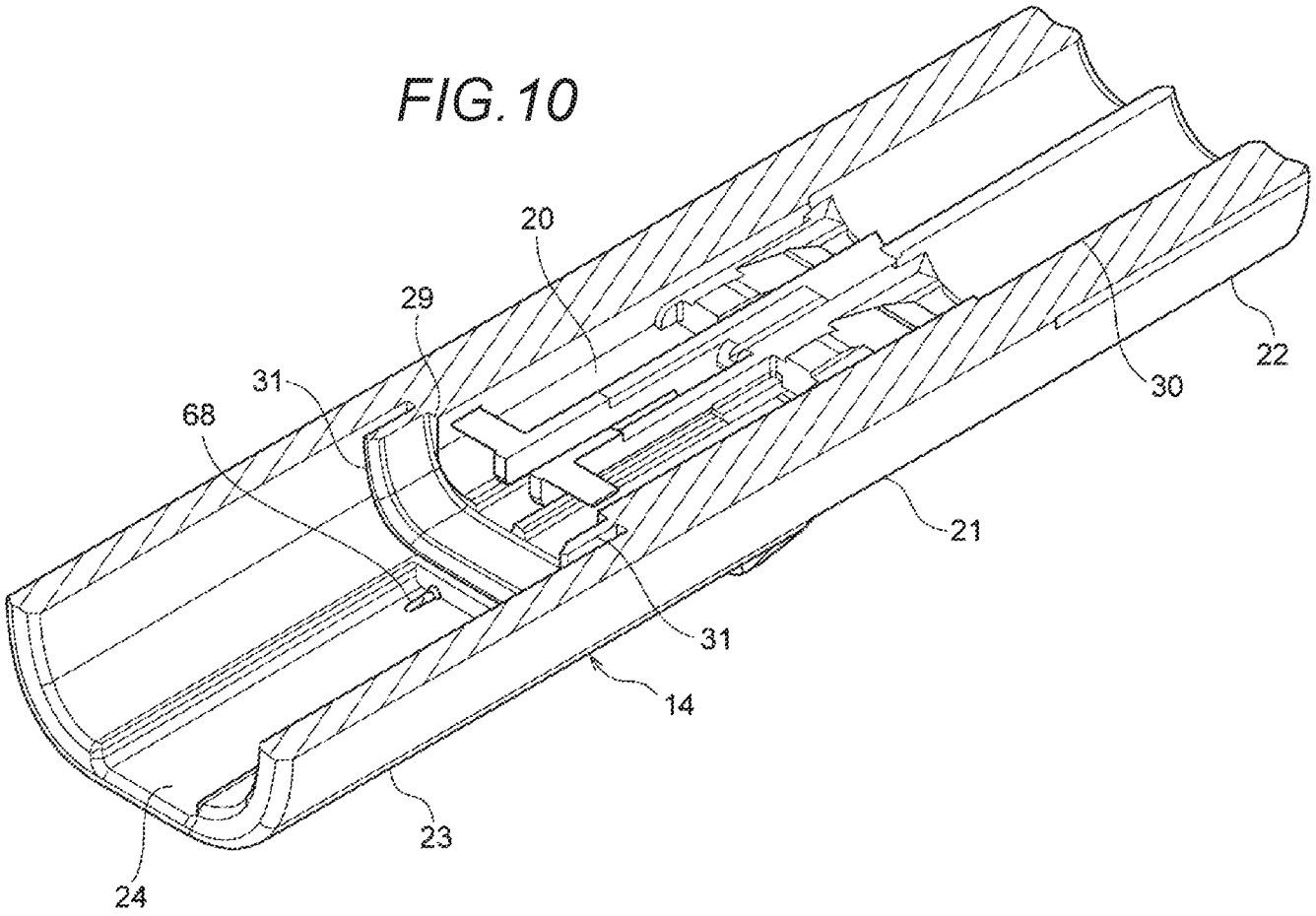
FIG. 10 is a perspective sectional view of the lower half of the male connector in FIG. 3 when viewed from the inside.

In addition, as illustrated in FIG. 10, on the inner circumferential surface of the male housing 14, a pair of protrusions 68 are provided on the rear side of the groove bottom of the guide groove 24. The pair of protrusions 68 are disposed substantially in parallel to be separated from each other in the width direction and are formed to have a semicircular shape in the sectional plane and to extend in the axial direction. The protrusions 68 are continuous to the groove bottom of the guide groove 24 on the front side and to the inclined surface. Further, the guide groove 24 can be formed as a flat stepped surface having a different height, instead of the pair of protrusions 68.

Figure 11A:
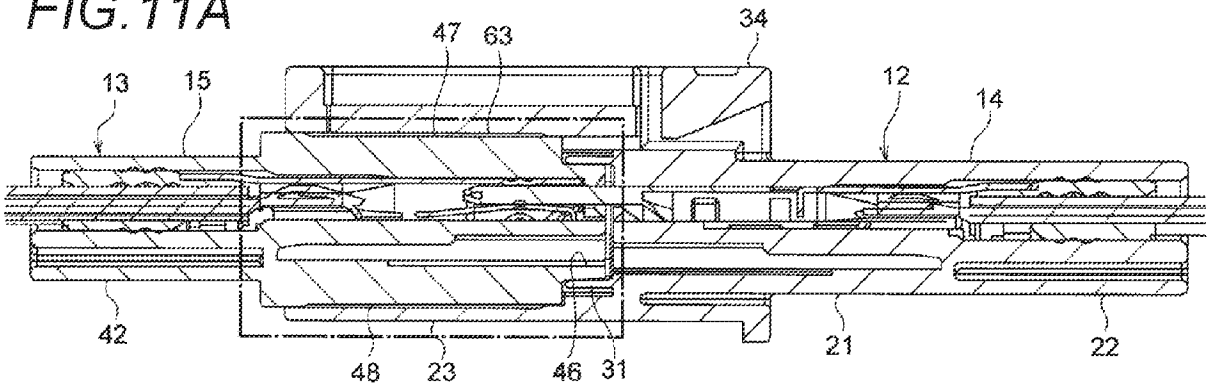
FIG. 11A and FIG. 11B are views illustrating a fitting state of the male connector and the female connector.
Figure 11B:
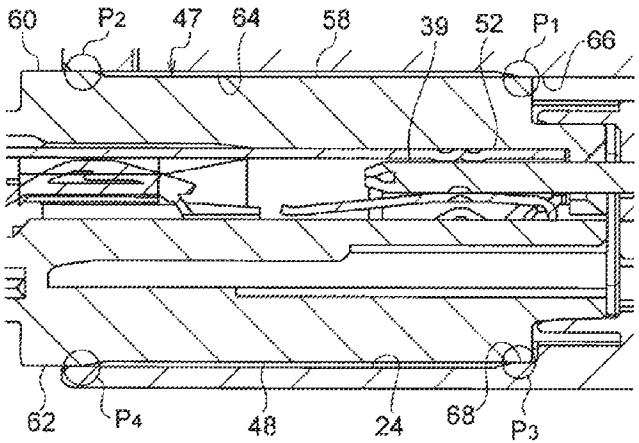

In the present embodiment, when the female housing 15 fits to the male housing 14, as illustrated in FIG. 11A and FIG. 11B, the top-surface portion 58 (first step portion) on the front side of the rib 47 of the female housing 15 on the upper side comes into contact with the rear under-surface portion 66 (third step portion) of the groove 63 of the male housing 14 at a contact portion $P_1$ and the rear top-surface portion 60 (second step portion) of the rib 47 of the female housing 15 comes into contact with the under-surface portion 64 (fourth step portion) on the front side of the groove 63 of the male housing 14 at a contact portion $P_2$.

In addition, as illustrated in FIG. 11A and FIG. 11B, the front side (first step portion) of the stepped portion 48 of the female housing 15 comes into contact with the pair of protrusions 66 (third step portion) of the guide groove 24 of the male housing 14 at a contact portion $P_3$ and the pair of protrusions 62 (second step portion) on the rear side of the stepped portion 48 of the female housing comes into contact with the groove bottom (fourth step portion) on the front side of the guide groove 24 of the male housing 14 at a contact portion $P_4$.

Figure 12A:
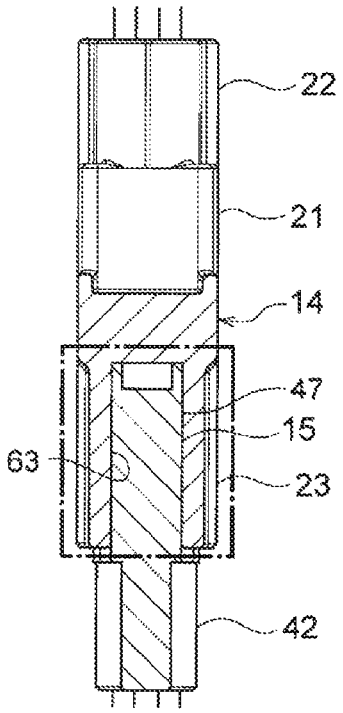
FIG. 12A and FIG. 12B are views illustrating the fitting state of the male connector and the female connector.
Figure 12B:
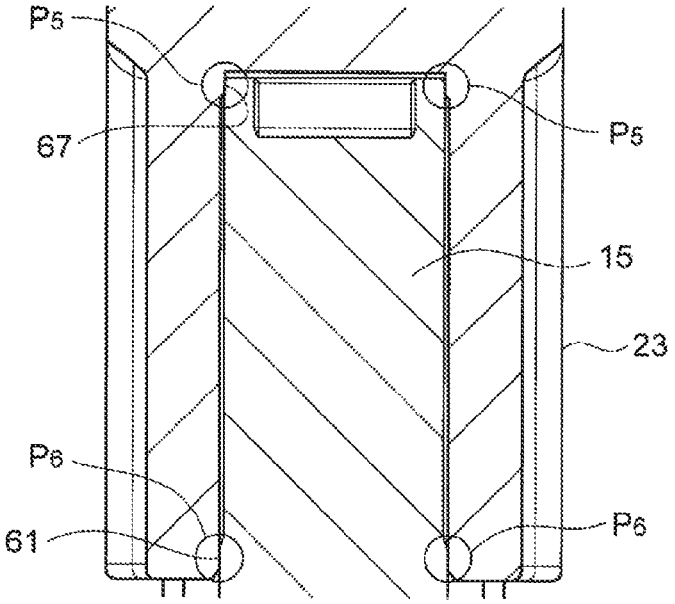
Figure 13:
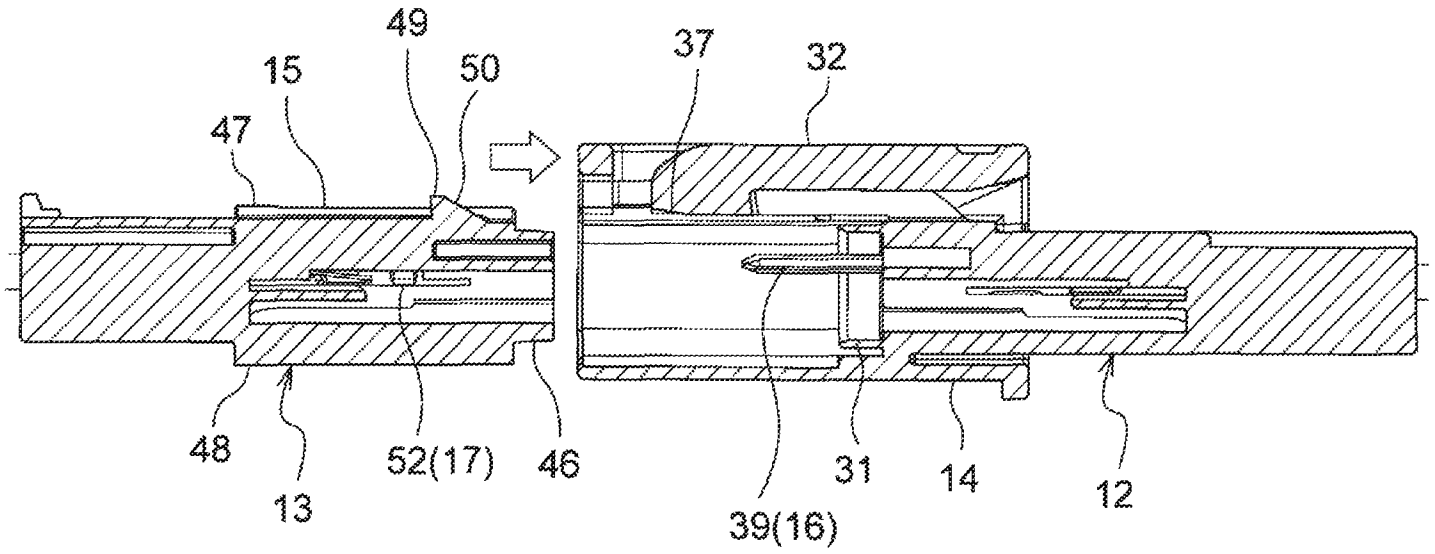
FIG. 13 is a view of an operation performed before fitting of the male connector and the female connector.

Further, as illustrated in FIG. 12A and FIG. 12B, in the width direction on the right and left side, the side-surface portion 59 (first step portion) on the front side of the rib 47 of the female housing 15 comes into contact with the rear side-surface portion 67 (third step portion) of the groove 63 of the male housing 14 at a contact portion $P_5$ and the rear side-surface portion 61 (second step portion) of the rib 47 of the female housing comes into contact with the side-surface portion 65 (fourth step portion) on the front side of the groove 63 of the male housing 14 at a contact portion $P_6$.

Next, an example of a fitting operation of both housings will be described. First, as illustrated in FIG. 1, the male terminal accommodating chamber 20 of the male housing 14 accommodates the male terminal 16, to which a terminal of the electric wire 18, on which a rubber plug 69 is mounted, is connected, along with the rubber plug 69. In addition, the female terminal accommodating chamber 40 of the female housing 15 accommodates the female terminal 17, to which the electric wire 19, on which a rubber plug 70 is mounted, is connected, along with the rubber plug 70. In this state, as shown with an arrow in FIG. 13, the female housing 15 is inserted into the male housing 14.

When the female housing 15 is inserted into the male housing 14, each of the pair of ribs 47 of the female housing 15 passes through the groove opening 26 of the male housing 14 and the locking portion 49 of the female housing 15 passes through the notched section 27 of the male housing 14. The ribs 47 pass through the groove opening 26, and then is guided along the groove 63 in the axial direction. At this time, the stepped portion 48 of the female housing 15 engages with the guide groove 24 of the male housing 14 and is guided along the guide groove 24.

Subsequently, when the insertion of the female housing 15 progresses, the locking arm 32 of the male housing 14 covers the locking portion 49 along the inclined surface 50 of the locking portion 49 of the female housing 15 and the arm section 36 is bent and deformed upward. Also, a locking portion 37 of the arm section 36 moves over the locking portion 49, and thereby the arm section 36 is elastically restored. In this manner, the locking portion 49 is locked to the locking portion 37 and both housings are locked in a normal fitting state.

At this time, as illustrated in FIG. 7, movement of the female-side annular member 46 inserted into the male-side annular member 31 is stopped in a mode of pressing the inner circumferential surface of the male-side annular member 31 over the entire periphery. The distal end portion of the male-side annular member 31 is elastically deformed to be widened on the outer side due to the pressure; however, a restoring force due to the elastic deformation presses the outer circumferential surface 57 of the female-side annular member 46. Accordingly, the front end portion of the male-side annular member 31 and the rear end portion of the female-side annular member 46 enter into a close contact state to each other over the entire periphery and the gap between the opening end 29 of the male connector 12 and the opening end 44 of the female connector 13 are sealed to be watertight.

In comparison, as illustrated in FIG. 11A and FIG. 11B, on the upper side, in the female housing 15 fitted in the male housing 14, each of the pair of ribs 47 comes into contact with the groove 63 of the male housing 14 at the contact points $P_1$ and $P_2$ and, on the lower side, the stepped portion 48 comes into contact with the guide groove 24 of the male housing at the contact points $P_3$ and $P_4$. In this manner, since the ribs 47 and the stepped portion 48 of the female housing 15 are supported by the male housing 14 in the height direction at two positions separated from each other in the axial direction, the movement of the female housing 15 in the vertical direction or shaky fitting as inclination in the vertical direction with respect to the axis can be prevented.

Further, as illustrated in FIG. 12A and FIG. 12B, in the female housing 15 fitted in the male housing 14, each of the pair of ribs 47 comes into contact with the groove 63 of the male housing 14 in the width direction at the contact points $P_5$ and $P_6$. In this manner, since the ribs 47 and the stepped portion 48 of the female housing 15 are supported by the male housing 14 in the width direction at two positions separated from each other in the axial direction, the movement of the female housing 15 in the width direction or shaky fitting as inclination in the width direction with respect to the axis can be prevented.

In addition, in the present embodiment, since the pair of ribs 47 of the female housing 15 engages with the groove 63 of the male housing 14 and both housings enter into a fitting state in a mode in which the stepped portion 48 of the female housing 15 engages with the guide groove 24 of the male housing 14, relative rotations of the male and female housings around the axis are regulated, respectively. Accordingly, when the electric wire 19 sticking out from the female housing 15 is bent, a bending load of the electric wire 19 can be received by the groove 63 and the guide groove 24, it is possible to prevent the shaky fitting of the female housing 15 in the rotational direction.

As described above, according to the present embodiment, since the female housing 15 fitted in the male housing 14 can be supported by the male housing 14 in the respective vertical and width directions, it is possible to prevent the female housing 15 from shaky fitting in the vertical direction and the width direction. Also, even when the electric wire 19 sticking out from the female housing 15 is bent and the bending load is applied to the male housing 14, it is possible to maintain the position or orientation of the female housing 15 in a normal state. Accordingly, in the fitting state of the male housing 14 and the female housing 15, it is possible to stably maintain the close contact between the female-side annular member 46 and the male-side annular member 31, and thus it is possible to suppress deterioration of the sealability.

In addition, in the present embodiment, since the female housing 15 is supported at the respective positions of the male housing 14, which are separated from each other in the axial direction, it is possible to reduce an inserting load generated when the female housing 15 is inserted into the male housing 14 and thus it is possible to achieve smooth assembly.

As above, the embodiments of the present invention is described in detail with reference to the drawings; however, the above embodiments means only the examples of the present invention and modifications and alterations can be performed within the scope of the claims.

For example, in the present embodiment, an example, in which the sealing structure of the gap between the opening end 29 of the male housing 14 and the opening end 44 of the female housing 15 is configured of resin annular members 31 and 46, is described; however, the sealing structure is not limited to the configuration in which such a resin member is used, and, for example, it is possible to employ a known configuration in which rubber packing is used. Even in this case, according to the present invention, since it is possible to prevent the female housing 15 fitted in the male housing 14 from shaky fitting, it is possible to prevent a part of packing from being intensely pressed against the female housing 15 and from being crushed and it is possible to secure the sealability.

In addition, in the present embodiment, an example, in which the step-shaped surface extending in the axial direction is formed, for example, on the rib 47 or the stepped portion 48 as a part of the outer circumferential surface of the female housing 15 and the step-shaped surface extending in the axial direction is formed on a corresponding part of the inner circumferential surface of the male housing 14, is described; however, it is possible to provide the step-shaped surface at another position or it is possible to provide the step-shaped surface all over the entire periphery of the outer circumferential surface of the female housing 15 and of the inner circumferential surface of the male housing 14.

Further, in the present embodiment, an example, in which the inclined surface is provided on the outer circumferential surface 57 of the female-side annular member 46 and the outer circumferential surface 57 presses the inner circumferential surface 53 of the male-side annular member 31; however, instead of this, it is possible to employ a configuration in which an inclined surface is provided on the inner circumferential surface of the female-side annular member 46 and the inner circumferential surface 56 presses the outer circumferential surface 54 of the male-side annular member 31, or it is possible to employ a configuration in which inclined surfaces are provided on inner and outer circumferential surfaces of the male-side annular member 31 and the inner and outer circumferential surfaces of the female-side annular member 46 are pressed.

DESCRIPTION OF REFERENCE NUMERALS AND SIGNS

11 connector
12 male connector
13 female connector
14 male housing
15 female housing
16 male terminal
17 female terminal
20 male terminal accommodating chamber
24 guide groove
29 opening end
31 male-side annular member
40 female terminal accommodating chamber
44 opening end
46 female-side annular member
47 rib
48 step portion
58 top surface section
59 side surface section
60 rear top-surface section
61 rear side-surface section
62 protrusion
66 rear under-surface section
67 rear side-surface section
68 protrusion

What is claimed is:

1. A fitting structure of a connector which fits a pair of housings to each other, at least one of the pair of housings configured to be subject to a bending load, the fitting structure of the connector comprising:

a first step portion and a second step portion on at least a part of an outer circumferential surface of one housing; and a third step portion and a fourth step portion on at least a part of an inner circumferential surface of the other housing, wherein the first step portion extends in an axial direction, wherein the second step portion protrudes more highly than the first step portion and is positioned on a rear side of the first step portion and extends in the axial direction, wherein the third step portion is in contact with the first step portion along the axial direction and extends in the axial direction, wherein the fourth step portion is in contact with the second step portion and extends in the axial direction;

a fifth step portion and a sixth step portion on at least a part of an outer circumferential surface of one housing; and a seventh step portion and an eighth step portion on at least a part of an inner circumferential surface of the other housing, wherein the fifth step portion extends in an axial direction, wherein the sixth step portion protrudes more highly than the fifth step portion and is positioned on a rear side of the fifth step portion and extends in the axial direction, wherein the seventh step portion is in contact with the eighth step portion along the axial direction and extends in the axial direction, wherein the eighth step portion is in contact with the sixth step portion and extends in the axial direction, wherein the third step portion and the fourth step portion have only one level difference in a direction that the second step portion protrudes, and wherein the seventh step portion and the eighth step portion have only one level difference in a direction that the second step portion protrudes.

2. The fitting structure of the connector according to claim 1, further comprising:

a rib protruding from the outer circumferential surface of the one housing and extending in the axial direction; and a groove for guiding the rib in the inner circumferential surface of the other housing, wherein the first step portion and the second step portion are formed on the rib, and wherein the third step portion and the fourth step portion are formed on the groove.

3. The fitting structure of the connector according to claim 1, wherein each of the pair of housings comprises annular resin member on a peripheral edge of an opening end of a cavity in which a terminal is accommodated, wherein the annular resin member of the one housing and the annular resin member of the other housing are fit to each other, wherein any one of the annular members is formed as a configuration that a distal end portion is pressed against an inner circumferential surface or an outer circumferential surface of the other of the annular members when the pair of housings fits to each other.

4. The fitting structure of the connector according to claim 2, wherein the first step portion is a front top-surface portion of the rib of the one housing, wherein the second step portion is a rear top-surface portion of the rib of the one housing, wherein the third step portion is a rear bottom-surface portion of the groove of the other housing, wherein the fourth step portion is a front-surface portion of the groove of the other housing.

5. The fitting structure of the connector according to claim 2, wherein each of the pair of housings comprises annular resin member on a peripheral edge of an opening end of a cavity in which a terminal is accommodated, wherein the annular resin member of the one housing and the annular resin member of the other housing are fit to each other, wherein any one of the annular members is formed as a configuration that a distal end portion is pressed against an inner circumferential surface or an outer circumferential surface of the other of the annular members when the pair of housings fits to each other.

6. The fitting structure of the connector according to claim 1, wherein the other housing includes an opening into which the one housing is inserted to be fit with the other housing, and the inner circumferential surface includes a planar surface that extends from the third step portion to the opening.

7. The fitting structure of the connector according to claim 6, wherein the third step portion protrudes from the planar surface.

8. The fitting structure of the connector according to claim 7, wherein the fourth step portion abuts the opening and is formed on the planar surface so as to be co-planar with the planar surface.

9. A first connector configured for insertion into an opening of a second connector, the second connector having a housing defining an inner circumferential surface with first, second, third and fourth contact portions formed thereon, the first contact portion protruding beyond the second contact portion and the third contact portion protruding beyond the fourth contact portion, the first connector comprising:

a housing defining an outer circumferential surface;

a fifth contact portion formed on at least a first part of the outer circumferential surface and configured to abut the first contact portion;

a sixth contact portion formed on at least a second part of the outer circumferential surface that is coplanar with the first part thereof and configured to abut the second contact portion, the sixth contact portion protruding beyond the fifth contact portion in a radial direction;

a seventh contact portion formed on at least a first part of the outer circumferential surface and configured to abut the third contact portion; and an eighth contact portion formed on at least a second part of the outer circumferential surface that is coplanar with the first part thereof and configured to abut the second contact portion, the eighth contact portion protruding beyond the seventh contact portion in a radial direction.

10. The first connector of claim 9, wherein the first part of the outer circumferential surface is spaced from the second part thereof such that radial movement of the first connector relative to the second connector is substantially impeded.

11. The first connector of claim 9, further comprising a locking portion on at least a part of the outer circumferential surface to thereby lock the first connector and the second connector in a normal fitting state.

12. The first connector of claim 1, further comprising a locking portion on at least a part of the outer circumferential surface of the one housing to thereby lock the one housing and the other housing in a normal fitting state.

* * * * *